US005418515A

United States Patent [19]

Reyes

[11] Patent Number: 5,418,515

[45] Date of Patent: May 23, 1995

[54] FUSE INTERRUPTION INDICATOR AND INTEGRAL EXTRACTOR

[76] Inventor: Daniel Reyes, 11728 Wilshire Blvd. #B-714, Los Angeles, Calif. 90025

[21] Appl. No.: 173,959

[22] Filed: Dec. 22, 1993

[51] Int. Cl.[6] ..... H01H 85/30

[52] U.S. Cl. ..... 337/206; 337/211

[58] Field of Search ..... 337/206, 208, 211, 186, 337/187

[56] References Cited

U.S. PATENT DOCUMENTS

| | | | |
|---|---|---|---|
| 2,234,480 | 11/1941 | Scmidt | 200/119 |
| 2,274,059 | 2/1942 | Goodwin | 200/130 |
| 3,319,027 | 5/1967 | Hitchcock | 200/120 |
| 3,457,535 | 7/1969 | Poehlman | 337/244 |
| 3,513,427 | 5/1970 | Browne et al. | 337/243 |
| 3,519,971 | 7/1970 | Cameron | 337/241 |
| 3,601,739 | 8/1971 | Biewitt | 337/244 |
| 3,663,915 | 5/1972 | Kozacka | 337/244 |
| 3,665,361 | 5/1972 | Williams | 337/265 |
| 3,671,910 | 6/1972 | Kozacka | 337/146 |
| 3,696,316 | 10/1972 | Kitagawa et al. | 337/206 |
| 3,721,936 | 3/1973 | Belcher | 337/241 |
| 3,783,428 | 3/1974 | Swain et al. | 337/148 |
| 3,824,520 | 7/1974 | Knapp, Jr. | 337/161 |
| 3,832,665 | 8/1974 | Belcher | 337/244 |
| 3,863,191 | 1/1975 | Salzer | 337/244 |
| 3,895,338 | 7/1975 | Cuzzone et al. | 337/244 |
| 3,909,767 | 9/1975 | Williamson et al. | 337/264 |
| 4,023,133 | 5/1977 | Knapp, Jr. | 337/206 |
| 4,058,784 | 11/1977 | Gaia | 337/164 |
| 4,060,786 | 11/1977 | Cuzzone | 337/244 |
| 4,127,837 | 11/1978 | Borchart | 337/265 |
| 4,156,225 | 5/1979 | Cuzzone | 337/244 |
| 4,186,365 | 1/1980 | Fahnoe | 337/206 |
| 4,204,182 | 5/1980 | Knapp, Jr. | 337/244 |
| 4,323,874 | 4/1982 | Link | 337/244 |
| 4,475,283 | 10/1984 | Borzoni et al. | 29/720 |
| 4,499,447 | 2/1985 | Greenberg | 337/266 |
| 4,511,876 | 4/1985 | Urani | 337/244 |
| 4,593,262 | 6/1986 | Krueger | 337/163 |
| 4,603,315 | 7/1986 | Leong et al. | 337/243 |
| 4,695,815 | 9/1987 | Hwang | 337/266 |
| 4,712,081 | 12/1987 | Bosley | 337/266 |
| 4,766,408 | 8/1988 | Cameron et al. | 337/244 |
| 4,912,449 | 3/1990 | Bonhomme | 337/244 |
| 5,002,505 | 3/1991 | Heidorn et al. | 439/622 |
| 5,004,995 | 4/1991 | Lo | 337/261 |
| 5,055,818 | 10/1991 | Bueschel | 337/267 |
| 5,111,177 | 5/1992 | Krueger et al. | 337/243 |
| 5,113,169 | 5/1992 | Ruehl et al. | 337/265 |

*Primary Examiner*—Lincoln Donovan

[57] ABSTRACT

A fuse interruption indicator with physical attributes which allow convenient observation of the interrupted fuse either through visual or tactile inspection. The indicator is subsequently employed as a self contained method of interrupted fuse extraction, requiring no additional tools. Further allows the use of less expensive materials and usage with existing technologies and practices.

25 Claims, 7 Drawing Sheets

FUSE INTERRUPTION INDICATOR AND INTEGRAL EXTRACTOR

BACKGROUND OF THE INVENTION

1. Field of the Invention

The present invention relates generally to fuse interruption indicators, more particularly to a fuse interruption indicator with visual and tactile physical attributes which are utilized to extract a fuse from a fuse receptacle.

2. Description of the Prior Art

Various electrical equipment, such as those used in the automotive industry, are generally protected from electrical current overload by disposable fuses. Such fuses are most often composed of a transparent housing with two conductive terminals joined by a meltable link.

When a fuse reaches overload, the meltable link melts due to high heat caused by excessive current moving through the fuse, this in turn interrupts the electrical circuit and the electrical equipment previously supplied with electricity ceases to function. At this point the equipment operator must inspect the fuse in order to discover if the failure is fuse related or equipment related.

Fuses are inserted into fuse receptacles which are generally integral components of the electronic equipment. Often, with complex machinery containing an assortment of electronic equipment, such as an automobile, a multitude of fuse receptacles are placed in one fuse receptacle location. If the fuse receptacles are adequately marked and sufficient light exists to observe the fuse receptacle markings and to determine fuse conditions through the transparent fuse housings, then the determination of fuse failure or equipment failure is easily made. However when situations provide less than ideal observation conditions, ascertaining, and ultimately exchanging, interrupted fuses with functioning fuses is both frustrating and tedious. Each of the numerous fuses appear and feel identical, and must be extracted and examined, often with the aid of additional lighting, before the interrupted fuse can be located.

As fuses require some force to remove, and are generally recessed within the fuse receptacle, it is often difficult to extract the fuse from its receptacle using only fingers due to the insufficient area of the fuse available for gripping. Fuses formed with handles or finger grips are impractical, in that the fuse receptacle location is usually configured with a minimum of space surrounding the fuse, and generally, a fuse receptacle cover is only a few millimeters from the top surface of the fuse.

The electrical equipment operator is generally required to posses a fuse removal tool, usually a two pronged device which the operator squeezes on the fuse housing and pulls with, in order to extract the fuse from its receptacle. The fuse removal tool must be kept in reasonable proximity to the electrical equipment, otherwise an inconvenient delay may be caused by locating, or acquiring the necessary fuse removal tool. Different types of fuses require differing types of fuse removal tools, consequently, equipment which utilizes differing fuse types requires the equipment operator to posses or acquire multiple fuse removal tools.

Inventors have created several methods for determining fuse continuity by utilizing fuse interruption indicators. Attempts have included thermal chemical methods such as U.S. Pat. Nos. 4,603,315 to Krueger et al. (1986) and 5,111,177 to Krueger et al. (1992) both of which coat the meltable link with a chemical composition which reacts to thermal conditions created by the meltable link in various stages of degradation and discolors the interior of a transparent housing. U.S. Pat. No. 4,127,837 to Botchart (1978) uses a thermal chemical reaction to remove a colored substance applied within the interior of a transparent housing. These methods require that the fuse housing be manufactured using a transparent material, which is more expensive than comparable opaque materials. In addition, these methods require sufficient light to examine the fuse and a fuse removal tool for easy fuse extraction.

Further attempts utilize light emitting visual sources such as U.S. Pat. No. 4,499,447 to Greenberg (1985) which shows a blade type fuse with a light source inserted into the fuse housing and wired in parallel with the meltable link. The light source is not activated and draws no current until the meltable link melts. This type of indicator is subject to reliability problems in that the electrical equipment must supply current to the fuse in order for the light source to function. Electrical equipment with a power outage will render this inoperative. Viewing the light source during bright light situations may be difficult and the light source is subject to vibration in vehicles and the filament or the wiring connection may fail. The indicator does not in any way facilitate fuse extraction.

Efforts have been made at mechanical indicators within the fuse housing. U.S. Pat. No. 3,665,361 to Williams (1972) shows a fuse with a meltable link used in conjunction with a previously biased spring member, which moves after the meltable link has melted. This has the disadvantage of requiring a transparent housing, which is costly, and requires that an additional light source be used in order to observe the fuse condition in low light situations. U.S. Pat. No. 3,824,520 to Knapp (1974) shows a polyphase fuse with large primary meltable links and a smaller secondary meltable link which restrains a spring loaded shaft. The spring pushes an end of the shaft out of the housing when the secondary meltable link melts. U.S. Pat. No. 5,113,169 to Frederiksen et al. (1992) shows a fuse with integrated internal arc snubbers which are spring loaded to move away from a transparent window which is costly and requires a light source in order to be observed in low light situations. These mechanical indicator inventions revolve around large commercial fuses which are simple to remove and so none of these inventions makes possible the utilization of the mechanical indicator to provide a method of fuse extraction.

U.S. Pat. No. 4,593,262 to Krueger (1986) shows a cylinder type fuse with a shaft orientated with an opening in one of the terminal end caps. In the event of the meltable link melting a spring pushes the shaft through the opening. This shaft may become encumbered by objects adjacent to the fuse receptacle, or may encounter another nearby fuse. As the indicator is expelled parallel to the fuse length, and consequently the fuse receptacle floor, it is difficult to use fingers to feel the indicator when it cannot be seen, and the indicator cannot be grasped to extract the fuse from the fuse receptacle.

In an attempt to combine an indicator with fuse removal, U.S. Pat. No. 4,475,283 to Borzoni et al. (1984) shows a fuse removal tool which uses an electrical circuit tester, however this device requires the use of specially configured fuses (U.S. Pat. No. 3,909,767), and the additional expense of the fuse removal tool itself, which must be stored in or near the electrical equipment. Placing the device upon a fuse causes a light source within the device to be wired in parallel with the meltable link, and fuses with the meltable link melted will cause the light source to draw current. The tester circuit utilizes an incandescent lamp which may become damaged and render the circuit tester inoperative. U.S. Pat. No. 5,002,505 to Heidorn (1992) shows a frame, which contains a light source, configured to fit piggyback upon a cylinder type fuse and subsequently the assembly is inserted into a fuse receptacle. The frame is formed to a substantial distance above the fuse housing to provide a graspable surface and retain the light source. This area of the frame will not fit within tightly configured fuse receptacle areas, as the frame will interfere with adjacent frames if an attempt is made to place this device in an area with a multitude of fuses, and the frame will interfere with the replacement of fuse receptacle covers. Once again the electrical equipment must supply current to the fuse in order for the light source to function and electrical equipment with a power outage will render this inoperative and viewing the light source during bright light situations may be difficult.

In a combination of fuse and fuse housing U.S. Pat. No. 3,696,316 to Kitagawa et al. (1971) shows a fuse which uses three conductive terminals, which are aligned with each other. This requires the specially configured fuse housing detailed in the same patent. The center terminal, and one adjacent terminal are joined by conductive members and a meltable link. The center terminal member is biased away from the other member and held in tension by a meltable link. The member is biased by a bend at its base and when the meltable link melts the center terminal member moves away from the other member and comes in contact with the third terminal. As the center terminal is the current carrier, this in turn shunts the current through the third terminal and activates an alarm circuit, which requires a power source, which may not be available at the time of inspection. The fuse housing has an opening through which the moved member may be seen, however this requires a light source and the moved member is below the housing surface and is not only difficult to feel, but as the moved member must draw current in order to activate the alarm circuit it would also be dangerous to touch, and so the moved member does not provide any method of fuse removal.

The current state of the art in the fields of fuse interruption indicators and fuse removal has not produced a fuse interruption indicator which is capable of providing a self contained fuse extraction method.

OBJECTS AND ADVANTAGES

It will be apparent from the foregoing that there exists a need for an improved fuse interruption indicator. The improved indicator being employed to determine individual fuse conditions quickly and conveniently while being further employed as a self contained fuse extractor.

Accordingly, it is the general object of this invention to provide an improved fuse interruption indicator.

It is an object of this invention to provide a fuse interruption indicator which enables the equipment operator to ascertain fuse conditions at a glance and so determine interrupted fuses in a multitude of fuses without individual inspection of each fuse.

It is a further object of this invention to provide a fuse interruption indicator which enables the equipment operator to ascertain fuse conditions in situations where the fuse cannot be seen and in low light situations, without additional electrical power, light sources, or mirrors.

It is an additional object of this invention to provide a fuse interruption indicator which enables the equipment operator to extract a fuse from a fuse receptacle without tools or devices.

It is another object of this invention to provide a fuse interruption indicator which functions with existing hardware and practices, including fuse receptacle locations, fuse removal tools, and automated insertion equipment.

It is an additional object of this invention to provide a fuse interruption indicator which will allow fuse housing configurations to be modified into alternative, economical and ergonomic shapes, and utilize advanced economical manufacturing methods.

It is a still further object of this invention to provide a less expensive fuse by eliminating the need for costly transparent materials.

These and other objects, features, and advantages of the present invention will become apparent from the following detailed descriptions of the preferred embodiments that are to be read in conjunction with the accompanying drawings.

SUMMARY OF THE INVENTION

The present invention resides in a visual and tactile interruption indicator for determining fuse conditions, without the removal of the fuse from its receptacle, the same indicator being employed for fuse extraction without the necessity of additional tools or devices.

The interruption indicator being capable of utilization in conjunction with existing fuse types without interfering with existing conditions and methods i.e. fuse extraction with fuse removal tools, use in fuse receptacle locations, use with automatic insertion equipment, and use with other manufacturing equipment.

The interruption indicator also being capable of utilization with new and different fuse configurations.

The preferred embodiments of the present invention are utilized interchangeably with existing blade type fuses, which are comprised of a substantially rectangular housing which partially encapsulates two parallel blade shaped terminals, and existing cylinder type fuses which are comprised of a tubular housing capped on each end by cup shaped terminal caps, without limiting utilization with other styles and types of fuses.

The first embodiment of the present invention is constructed within a fuse housing of either type. The housing having an inward cavity and an opening upon one side. Attached to the housing are terminals which conduct electricity and which temporally connect into an electrical circuit in such a way as to complete the electrical circuit when these terminals are joined by a meltable link.

A flange is inside the housing, aligned with the opening, and forced towards the opening by a spring. The flange has an extension which forms a gripping area and extends away from the opening. The gripping area has a further extension which terminates in a perpendicular projection, formed so that it extends beneath the meltable link, opposite to the opening. The projection is forced against the meltable link by the spring and prevents the flange from moving through the opening.

In the event that the link melts, the projection is freed and no longer retains the extension in place. The spring forces the flange through the opening so that the flange and the gripping area are outside the fuse housing and are readily identified as such, either through visual inspection or by touching the surface of the fuse housing.

The spring tension is such that should the flange come into contact with an adjacent obstacle such as a fuse receptacle cover, the flange will not interfere with the obstacle and will easily remain in a depressed position until the obstacle is removed.

The extension has protrusions which prevent the gripping area from completely exiting the housing and so the gripping area is pulled on to extract the fuse from the fuse receptacle.

In a subsequent embodiment the extension is elongated and, after the spring forces the flange and gripping area through the opening, is manually pulled substantially out of the housing to form an extended gripping surface.

An alternate embodiment of the present invention is constructed with the extension being supported on one end by an axle that interconnects with the housing.

In the event that the link melts, the flange is no longer held in place by the perpendicular projection and the spring forces the gripping area to pivot through the opening so that a section of the gripping area is outside the fuse housing.

The gripping area, which is prevented by the axle from exiting the housing, is now pulled on to extract the fuse from the fuse receptacle.

In a subsequent embodiment the gripping area is pivoted further to substantially extend out of the housing and so become an extended gripping surface.

A further embodiment of the present invention is constructed of a fuse housing with the terminals loosely attached by forming the housing with shafts which intersect openings formed in the terminals. The openings are larger than the shafts and permit the housing to move a limited distance relative to the terminals.

The housing has a projection which extends beneath the meltable link and is forced against the meltable link by a spring, and so prevents the housing from moving upward.

In the event that the link melts, the projection is freed and no longer retains the housing in place. The spring forces the housing upward and the top surface of the housing is now above the top surface of the other fuse housings in the fuse receptacle area.

The spring tension is such that should the housing come into contact with an adjacent obstacle such as a fuse receptacle cover, the housing will not interfere with the obstacle and will easily remain in a depressed position until the obstacle is removed.

The housing is now employed as a gripping area and is pulled upon. The housing shafts engage the edges of the openings in the terminals and the fuse is extracted from the fuse receptacle.

Alternately the shaft and opening configurations may be reversed whereby the shafts are formed with the terminals and the openings are formed in the housing.

In a subsequent embodiment the openings are elongated and the housing is manually pulled out and extends substantially above the other fuses in the fuse receptacle and forms an extended gripping surface.

An additional embodiment of the present invention is constructed with the housing formed in two segments, with the terminals attached to the first segment.

A second segment of the housing is loosely attached to the first segment by forming a shaft which intersects an opening formed in the first segment. The opening is larger than the shaft and permits the second segment to move a limited distance relative to the first segment.

The second segment has a projection which extends beneath the meltable link and is forced against the meltable link by a spring, and so prevents the second segment from moving upward.

In the event that the link melts, the projection is freed and no longer retains the second segment in place. The spring forces the second segment upward and the top surface of the second segment is now above the top surface of the other fuse housings.

The spring tension is such that should the second segment come into contact with an adjacent obstacle such as a fuse receptacle cover, the second segment will not interfere with the obstacle and will easily remain in a depressed position until the obstacle is removed.

The second segment is now employed as a gripping area and is pulled upon. The second segment shaft engages the edge of the opening in the first segment and extracts the fuse from the fuse receptacle.

In a subsequent embodiment the opening in the first segment is elongated and the second segment is manually pulled substantially out and extends above the other fuses in the fuse receptacle and forms an extended gripping surface.

DESCRIPTIONS OF THE DRAWINGS

DESCRIPTION OF THE PREFERRED EMBODIMENTS

Figure 1:
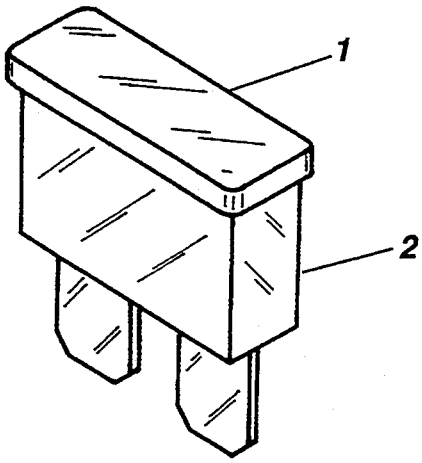
PRIOR ART FIGURE 1
FIG. 1 is a perspective view of an existing blade type fuse.
Figure 2:
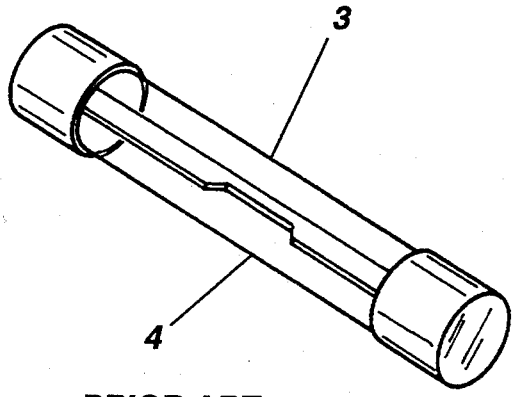
PRIOR ART FIGURE 2
FIG. 2 is a perspective view of an existing cylinder type fuse.
Figure 8:
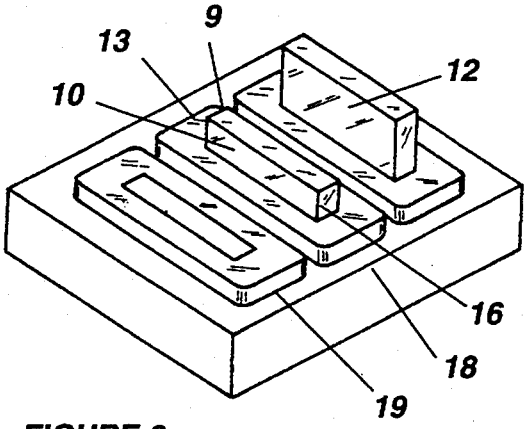
FIG. 8 is a perspective view of a fuse receptacle with three blade type fuses, which utilize a flange embodiment of the present invention.
Figure 26:
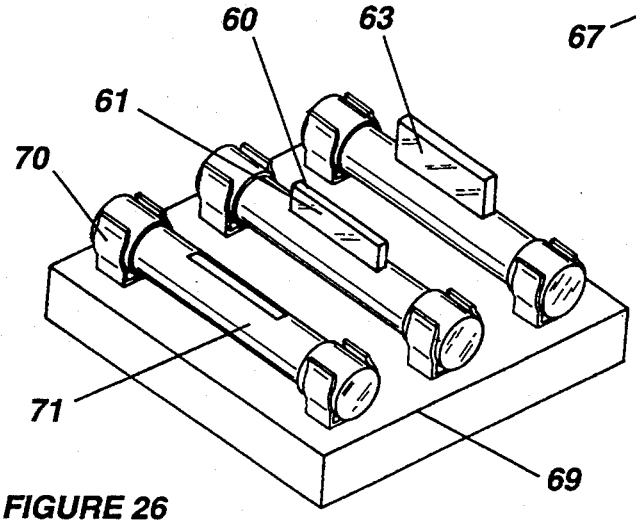
FIG. 26 is a perspective view of a fuse receptacle with three cylinder type fuses, which utilize a flange embodiment of the present invention.

As shown in the drawings for the purposes of illustration, the present invention is embodied in fuses of an existing blade type 1, as shown in FIG. 1, thus allowing the present invention to be used with an existing blade type fuse receptacle 18, as shown in FIG. 8 and an existing cylinder type 3, as shown in FIG. 2 thus allowing the present invention to be used with an existing cylinder type fuse receptacle 68, as shown in FIG. 26.

Blade Type Fuse with Flange Embodiment

The first embodiment of the invention is described with reference to FIG. 3–8.

Static Description.

Figure 3:
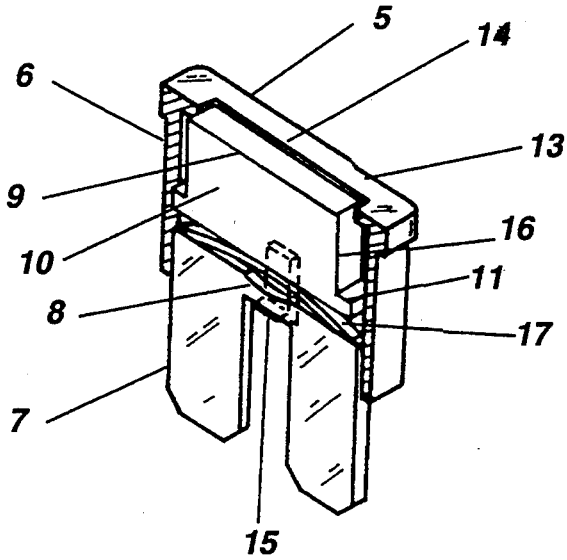
FIG. 3 is a cutaway perspective view of a blade type fuse utilizing a flange embodiment of the present invention, with the fuse in a state of electrical continuity.

In accordance with the invention, as shown in FIG. 3, a blade type fuse 5 is comprised of a housing 6 which is formed to approximate previously existing blade type fuse housing 2 shown in FIG. 1. Housing 6 partially encapsulates two parallel conductive blades 7 which are joined by a meltable link 8. Blades 7 push into female receptors (not shown) wired into an electrical circuit (not shown) and with meltable link 8 complete the circuit and allow current to pass through fuse 5 and on to an electrical device (not shown).

Figure 4:
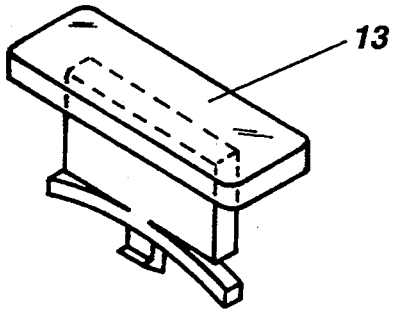
FIG. 4 is a perspective view of a flange encompassing a top surface.
Figure 5:
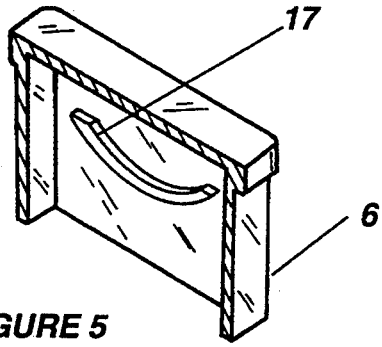
FIG. 5 is a cutaway perspective view of a spring formed integral with a housing.
Figure 6:
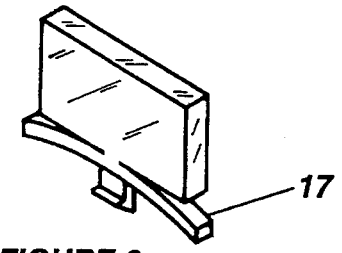
FIG. 6 is a perspective view of a spring taking the place of protrusions

A flange 9 is below a top .surface 13 of housing 6 inside an opening 14 shaped to allow flange 9 to move through opening 14 unobstructed. Alternately flange 9 may encompass top surface 13 as shown in FIG. 4. Flange 9 extends downward and forms an extension 16 which comprises a gripping area 10 and protrusions 11, and further extends to terminate in a projection 15 which is perpendicular to extension 16. Projection 15 extends beneath meltable link 8 in such a way as to prevent flange 9 from moving through opening 8 and is pressed against meltable link 8 by a curved leaf spring 17 shown formed with extension 16. Alternately spring 17 is formed as a component of housing 6 as shown in FIG. 5 or takes the place of protrusions 11, as shown in FIG. 6.

Description of Operation.

Figure 7:
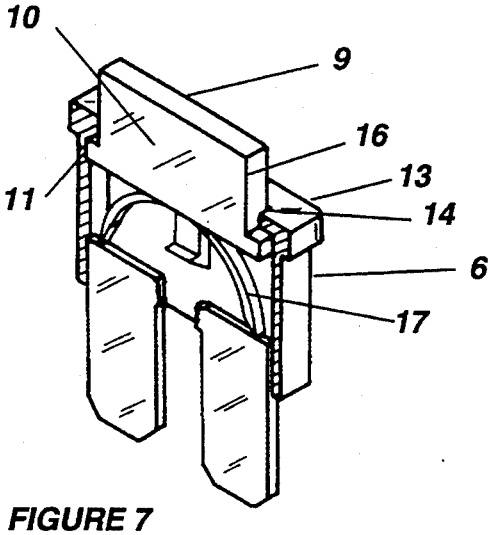
FIG. 7 is a cutaway perspective view of a blade type fuse utilizing a flange embodiment of the present invention, with the fuse in an interrupted state.

When meltable link 8 has melted, as shown in FIG. 7, projection 16 is no longer restrained and leaf spring 17 is free to push flange 9 through opening 14 and above top surface 13 of housing 6.

Flange 9 and gripping area 10, as shown in FIG. 8, are seen or felt above top surface 13 of housing 6 and operative fuse 19 when fuse receptacle 18 is inspected. Gripping area 10 is now pulled on and protrusions 11, or springs 17, engage housing 6 to remove fuse 5 from receptacle 18.

In a subsequent embodiment, extension 16 is elongated to form an extended gripping surface 12 which is manually pulled out an additional distance, as shown in FIG. 8.

Blade Type Fuse with Pivoted Flange Embodiment

An alternate embodiment of the invention is described with reference to FIG. 9–11.

Static Description.

Figure 9:
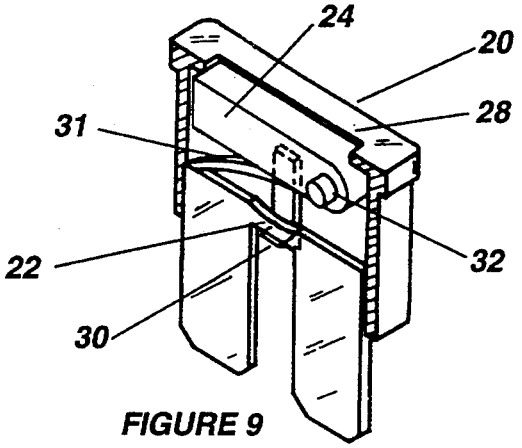
FIG. 9 is a cutaway perspective view of a blade type fuse utilizing a pivoted flange embodiment of the present invention, with the fuse in a state of electrical continuity.

In accordance with the invention, as shown in FIG. 9, blade type fuse 20 is constructed with extension 29 bisected at one end by an axle 32.

Description of Operation.

Figure 10:
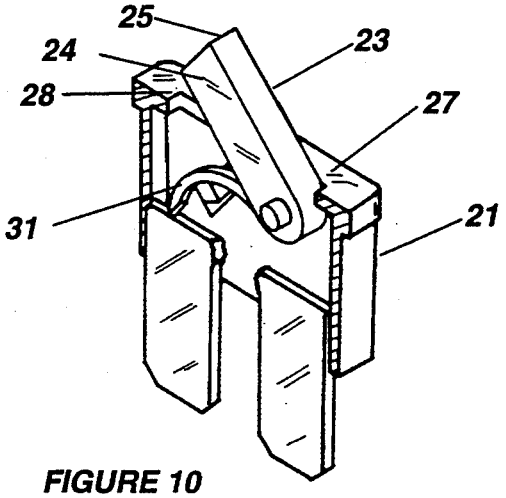
FIG. 10 is a cutaway perspective view of a blade type fuse utilizing a pivoted flange embodiment of the present invention, with the fuse in an interrupted state.

When meltable link 22 has melted as shown in FIG. 10, the projection 30 is no longer restrained and leaf spring 31 is free to pivot a corner 25 of flange 23 and gripping area 24 through opening 28 and above top surface 27 of housing 21.

Figure 11:
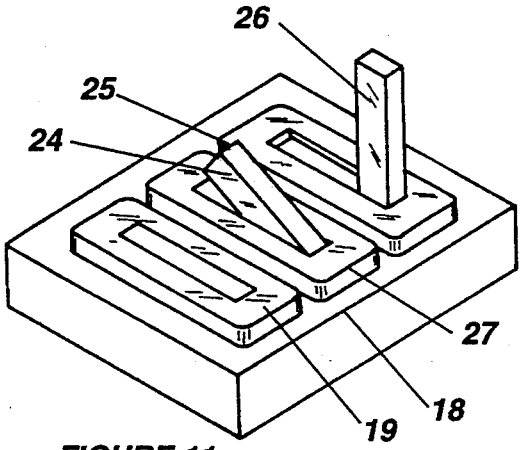
FIG. 11 is a perspective view of a fuse receptacle with three blade type fuses, which utilize a pivoted flange embodiment of the present invention.

Flange 23 and gripping area 24, as shown in FIG. 11, is seen or felt above top surface 27 of housing 21 and operative fuse 19 when fuse receptacle 18 is inspected. When gripping area 24 is pulled on, axles 32 engage housing 21 to remove fuse 20 from receptacle 18.

In a subsequent embodiment, extension 24 is elongated to form an extended gripping surface 26 which is manually pivoted further out of housing 21, as shown in FIG. 11.

Blade Type Fuse with Moving Housing Embodiment

An additional embodiment of the invention is described with reference to FIG. 12–16.

Static Description.

Figure 12:
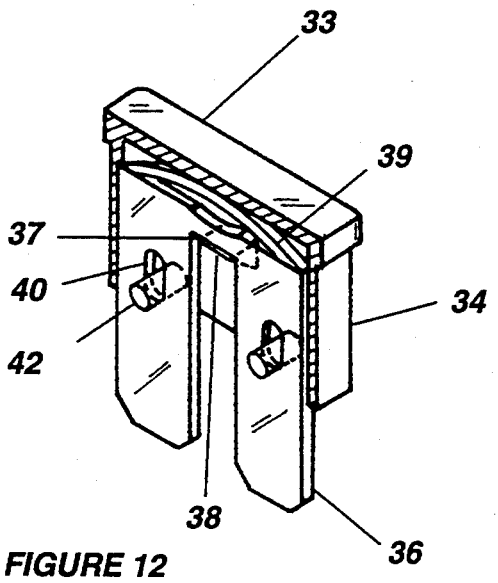
FIG. 12 is a cutaway perspective view of a blade type fuse utilizing a moving housing embodiment of the present invention, with the fuse in a state of electrical continuity.

In accordance with the invention, blade type fuse 33, as shown in FIG. 12, is comprised of housing 34 which partially encapsulates blades 36 which are connected by meltable link 37.

Figure 13:
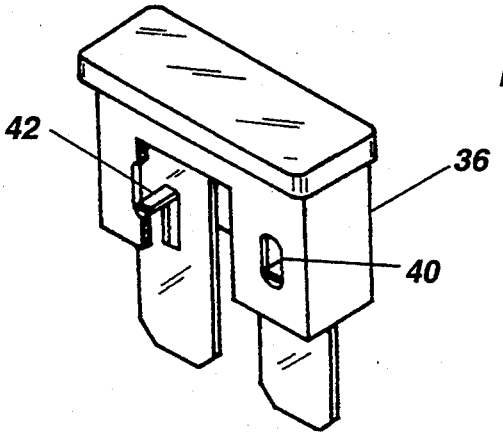
FIG. 13 is a cutaway perspective view of a blade type fuse utilizing a moving housing embodiment of the present invention, with alternate shafts and opening positions.

Housing 34 is constructed with two shafts 42 perpendicular to blades 36 in such a way as to allow shafts 42 to pass through openings 40 in blades 36. Alternately, shafts 2 are formed as part of blades 36 and openings 40 are formed as part of housing 34 as shown in FIG. 13.

Housing 34 is constructed with projection 38 which extends beneath meltable link 7 and is pressed against meltable link 37 by curved leaf spring 39.

Description of Operation.

Figure 14:
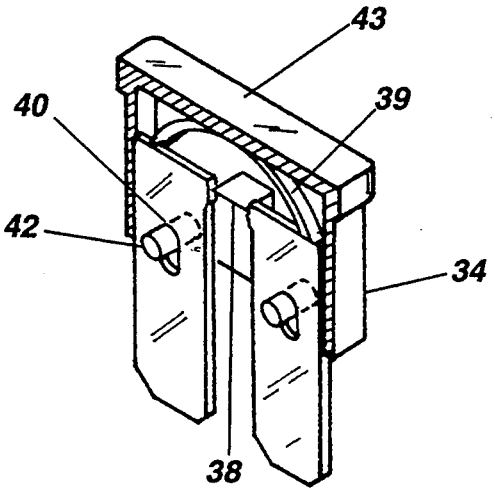
FIG. 14 is a cutaway perspective view of a blade type fuse utilizing a moving housing embodiment of the present invention, with the fuse in an interrupted state.

When meltable link 37 has melted as shown in FIG. 14, projection 38 is no longer restrained and leaf spring 39 moves housing 34 upward until shafts 42 engage edges of openings 40.

Figure 15:
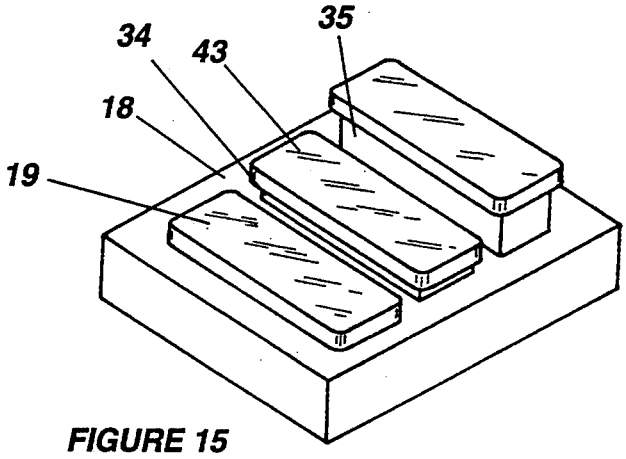
FIG. 15 is a perspective view of a fuse receptacle with three blade type fuses, which utilize a moving housing embodiment of the present invention.

Top surface 43, as shown in FIG. 15, is seen above operative fuse 19 in fuse receptacle 18. Housing 34 is pulled upward and shafts 34 apply force upon blades 36 to remove fuse 33 from fuse receptacle 18.

Figure 16:
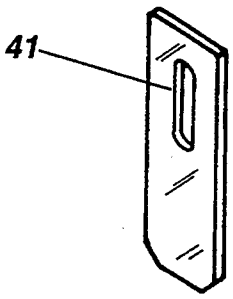
FIG. 16 is a perspective view of a blade terminal with an elongated opening.

In a subsequent embodiment elongated openings 41, as shown in FIG. 16, allow housing 34 to be manually pulled out an additional distance to reveal extended gripping surface 35, as shown in FIG. 15.

Blade Type Fuse with Split Housing Embodiment

A further embodiment of the invention is described with reference to FIG. 17–21.

Static Description.

Figure 17:
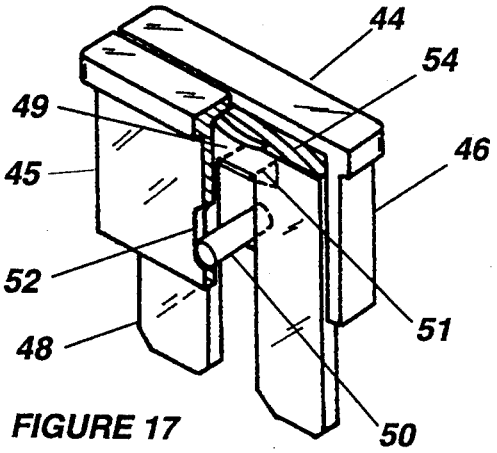
FIG. 17 is a cutaway perspective view of a blade type fuse utilizing a split housing embodiment of the present invention, with the fuse in a state of electrical continuity.

In accordance with the invention, blade type fuse 44, as shown in FIG. 17, is comprised of a first housing part 45 and a second housing part 46, and together partially encapsulate two parallel conductive blades 48 which are connected by meltable link 49. Blades 48 are fixed to interior of first housing part 45.

Figure 18:
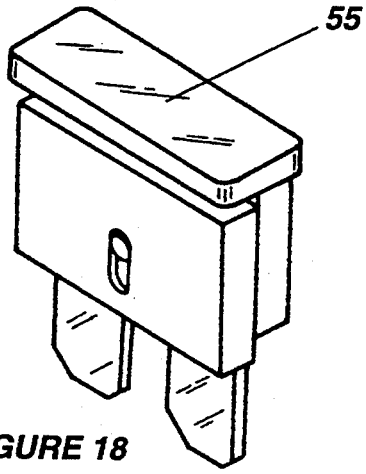
FIG. 18 is a perspective view of a blade type fuse with the movable half of the housing joined to the top surface.

Second housing part 46 is constructed with a shaft 50 perpendicular to blades 48. Shaft 50 intersects an opening 52 in first housing part 45. a perpendicular projection 51 is pressed against meltable link 49 by curved leaf spring 54. The top surface 55 may be split or connected to second housing part 46 as shown in FIG. 18.

Description of Operation.

Figure 19:
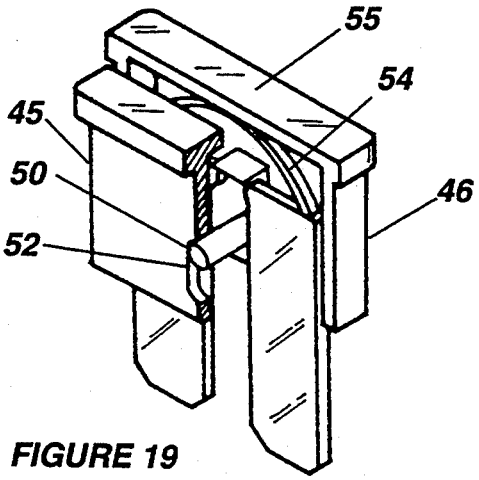
FIG. 19 is a cutaway perspective view of a blade type fuse utilizing a split housing embodiment of the present invention, with the fuse in an interrupted state.

When meltable link 49 has melted, as shown in FIG. 19, projection 51 is no longer restrained and leaf spring 54 moves second housing part 46 upward until shaft 50 engages edge of opening 52.

Figure 20:
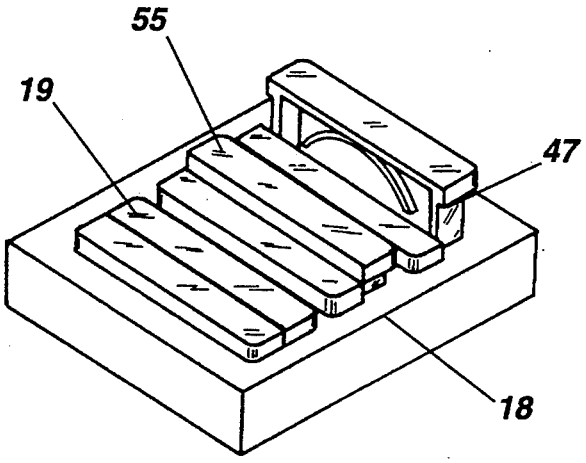
FIG. 20 is a perspective view of a fuse receptacle with three blade type fuses, which utilize a split housing embodiment of the present invention.

Housing top 55, as shown in FIG. 20, is seen above operative fuse 19 in fuse receptacle 18. Second housing part 46 is pulled upward and shaft 50 applies force upon first housing part 45 to remove fuse 44 from fuse receptacle 18.

Figure 21:
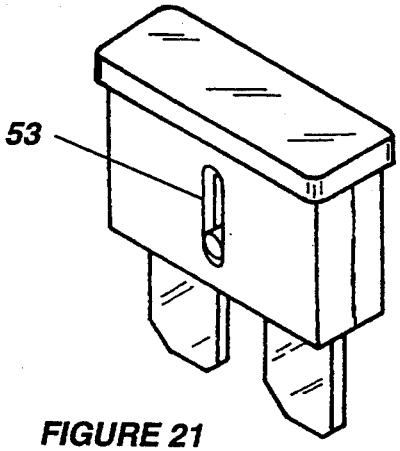
FIG. 21 is a perspective view of a housing face with an elongated opening.

In a subsequent embodiment an elongated opening 53, as shown in FIG. 21, allows second housing part 46 to be manually pulled out an additional distance to reveal extended gripping surface 47, as shown in FIG. 20.

Cylinder Type Fuse with Flange Embodiment

A further embodiment of the invention is described with reference to FIG. 22–26.

Static Description

Figure 22:
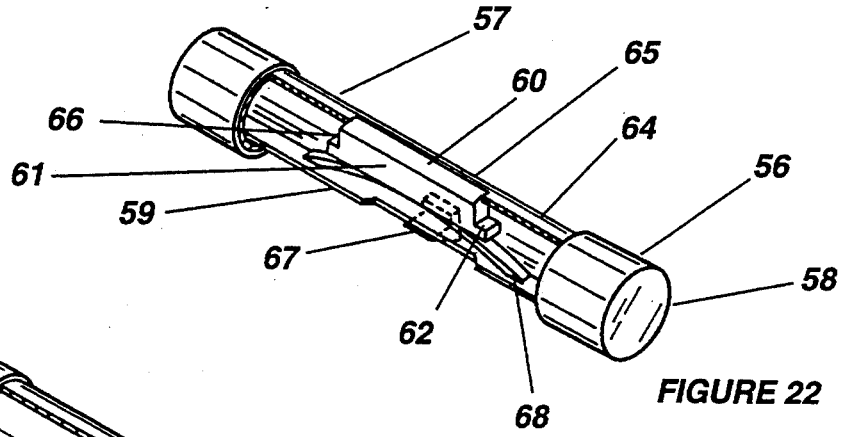
FIG. 22 is a cutaway perspective view of a cylinder type fuse utilizing a flange embodiment of the present invention, with the fuse in a state of electrical continuity.

Also in accordance with the invention, a cylinder type fuse 56, as shown in FIG. 22, is comprised of a housing 57 which is formed to approximate previously existing cylinder type fuse housing 4, shown in FIG. 2. Housing 57 is terminated on each end with a conductive cap 58 which are connected by a meltable link 59. Caps 58 push into snap receptors 70, shown in FIG. 26, which are wired into an electrical circuit (not shown) and with meltable link 59 complete the circuit and allow current to pass through fuse 55 and on to an electrical device (not shown).

Figure 23:
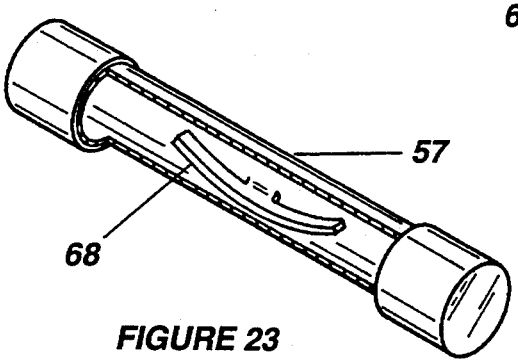
FIG. 23 is a cutaway perspective view of a spring formed integral with the housing.
Figure 24:
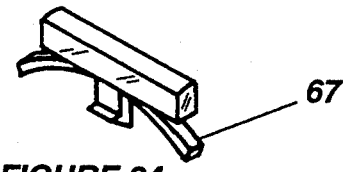
FIG. 24 is a perspective view of a spring taking the place of the protrusions

A flange 60 is below an outer surface 64 of housing 57 inside an opening 65 shaped to allow flange 60 to move through opening 65 unobstructed. Flange 60 extends downward and forms an extension 66 which comprises a gripping area 61 and protrusions 62, and further extends to terminate in a projection 67 which is perpendicular to extension 66. Projection 67 extends beneath meltable link 59 in such a way as to prevent flange 60 from moving through opening 65 and is pressed against meltable link 59 by a curved leaf spring 68 shown formed with extension 66. Alternately spring 68 is formed as a component of housing 57 as shown in FIG. 23 or takes the place of protrusions 62 as shown in FIG. 24.

Description of Operation.

Figure 25:
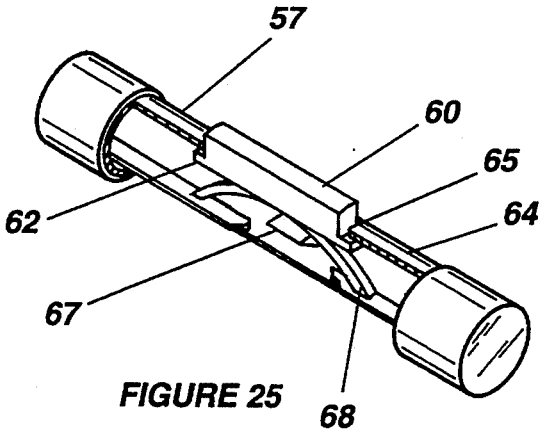
FIG. 25 is a cutaway perspective view of a cylinder type fuse utilizing a flange embodiment of the present invention, with the fuse in an interrupted state.

When meltable link 59 has melted, as shown in FIG. 25, projection 67 is no longer restrained and leaf spring 68 is free to push flange 60 through opening 65 and beyond outer surface 64 of housing 57.

Flange 60 and gripping area 61, as shown in FIG. 26 are seen or felt above outer surface 64 of housing 57 and operative fuse 71 when fuse receptacle 69 is inspected. Gripping area 61 is now pulled on and protrusions 62 engage housing 57 to remove fuse 6 from receptacle 69.

In a subsequent embodiment, extension 66 is elongated to form an extended gripping surface 63 which is manually pulled out an additional distance, as shown in FIG. 26.

Cylinder Type Fuse with Pivoted Flange Embodiment

An alternate embodiment of the invention is described with reference to FIG. 27–29.

Static Description

Figure 27:
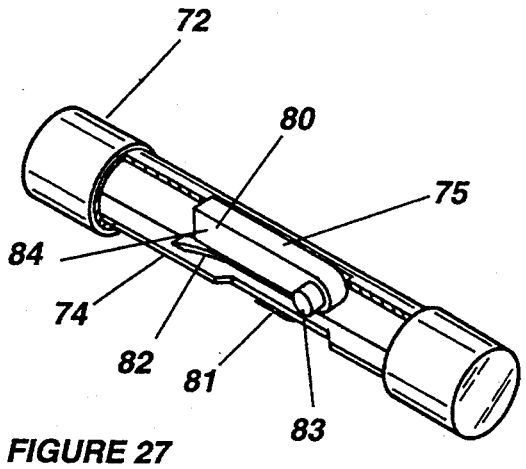
FIG. 27 is a cutaway perspective view of a cylinder type fuse utilizing a pivoted flange embodiment of the present invention, with the fuse in a state of electrical continuity.

Also in accordance with the invention, as shown in FIG. 27, cylinder type fuse 72 is constructed with extension 80 bisected at one end by an axle 83.

Description of Operation.

Figure 28:
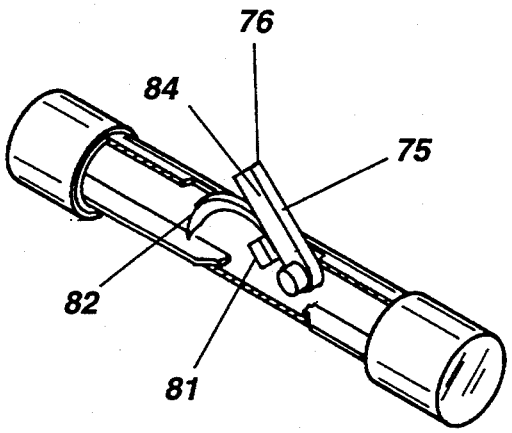
FIG. 28 is a cutaway perspective view of a cylinder type fuse utilizing a pivoted flange embodiment of the present invention, with the fuse in an interrupted state.

When meltable link 74 has melted, as shown in FIG. 28, projection 81 is no longer restrained and leaf spring 82 is free to pivot a corner 76 of flange 75 and gripping area 84 through opening 79 and beyond outer surface 78 of housing 73.

Figure 29:
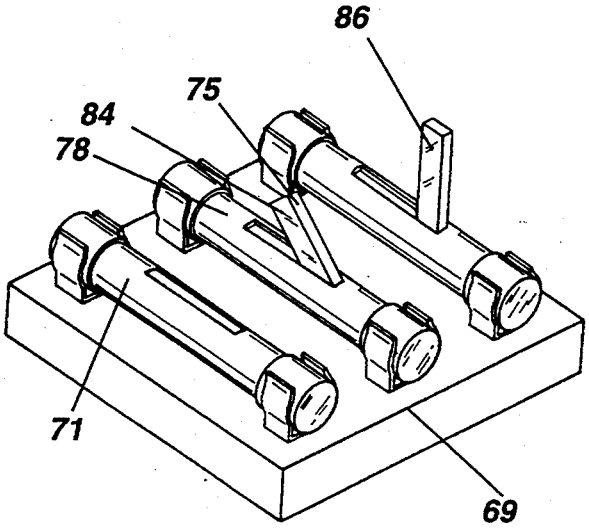
FIG. 29 is a perspective view of a fuse receptacle with three cylinder type fuses, which utilize a pivoted flange embodiment of the present invention.

Flange 75 and gripping area 84, as shown in FIG. 29, are seen or felt above outer surface 78 of housing 73 and operative fuse 71 when fuse receptacle 69 is inspected. When gripping area 84 is pulled on axles 83 engage housing 73 to remove fuse 72 from receptacle 69.

In a subsequent embodiment, extension 80 is elongated to form an extended gripping surface 77 which is manually pivoted further out of housing 73, as shown in FIG. 29.

Cylinder Type Fuse with Moving Housing Embodiment

A further embodiment of the invention is described with reference to FIG. 30-33.

Static Description.

Figure 30:
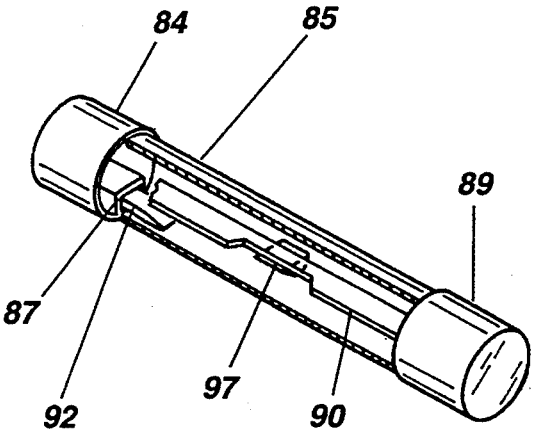
FIG. 30 is a cutaway perspective view of a cylinder type fuse utilizing a moving housing embodiment of the present invention, with the fuse in a state of electrical continuity.

Also in accordance with the invention, cylinder type fuse 84, as shown in FIG. 30, is comprised of housing 85 which is constructed with two springs 92, each projecting into an opening 87 in caps 89 in such a way as to allow housing 85 limited motion relative to caps 89.

Housing 85 is constructed with a projection 91 which extends beneath .meltable link 90 and is pressed against meltable link 90 by springs 92.

Description of Operation.

Figure 31:
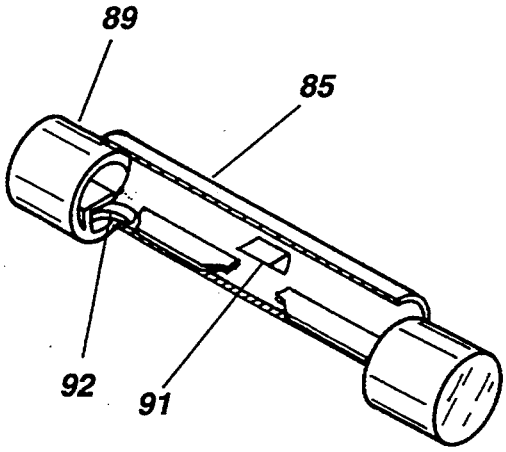
FIG. 31 is a cutaway perspective view of a cylinder type fuse utilizing a moving housing embodiment of the present invention, with the fuse in an interrupted state.

When meltable link 90 has melted as shown in FIG. 31, projection 91 is no longer restrained and springs 92 are free to push housing 85 beyond caps 89.

Figure 33:
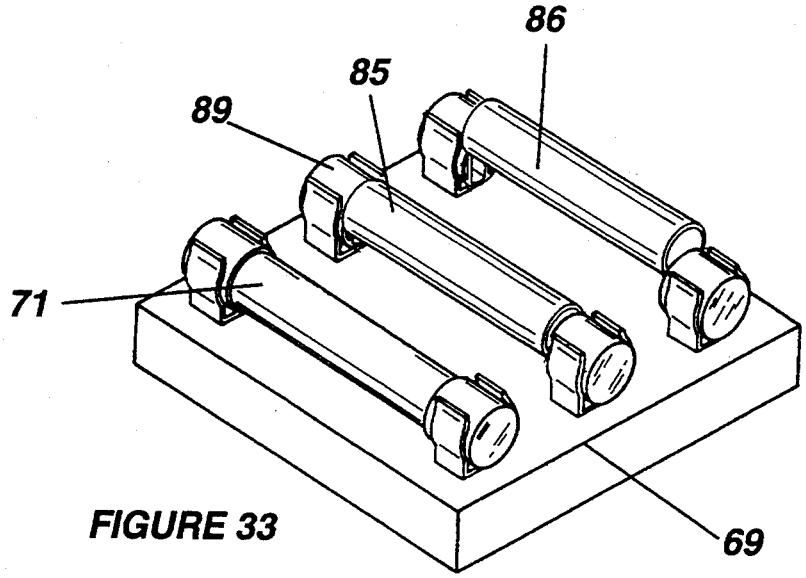
FIG. 33 is a perspective view of a fuse receptacle with three cylinder type fuses, which utilize a moving housing embodiment of the present invention.

Housing 85, as shown in FIG. 33, is seen or felt above operative fuse 71 in fuse receptacle 69. Housing 85 is pulled upward and springs 92 apply force upon caps 89 to remove fuse 84 from fuse receptacle 69.

Figure 32:
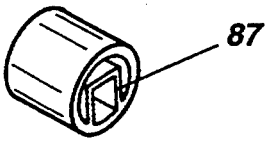
FIG. 32 is a perspective view of a terminal cap with an elongated opening.

In a subsequent embodiment elongated openings 87, as shown in FIG. 32, allow housing body 85 to be pulled out an additional distance to reveal extended gripping surface 86, as shown in FIG. 33.

Alternate Housing Configurations

Figure 34:
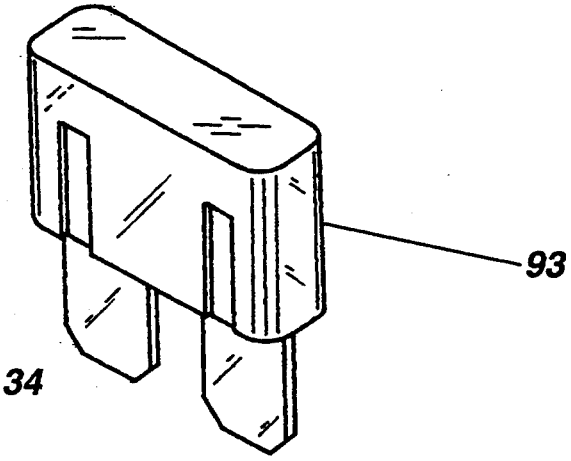
FIG. 34 is a perspective view of an alternatively configured blade type fuse.
Figure 35:
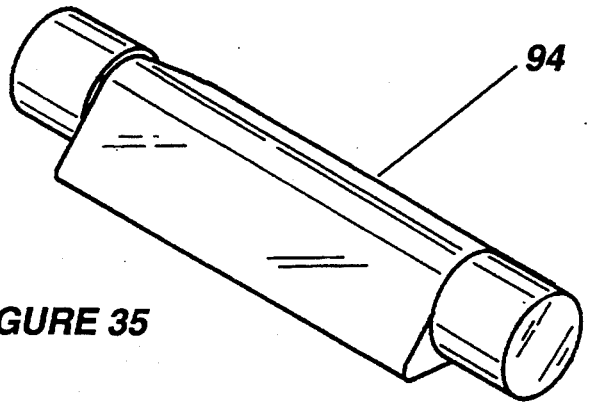
FIG. 35 is a perspective view of an alternatively configured cylinder type fuse.

The ease in which the present invention allows detection and removal of interrupted fuses allows blade type fuse housings 2 to have an alternatively configured housing 93 as shown in FIG. 34 and cylinder type fuse housings 4 to have an alternatively configured housing 94 as shown in FIG. 35, both alternatives allow the housings 93,94 to be made in a less expensive manner without having to be concerned with the housing shape with regard to interrupted fuse removal.

Conclusions, Ramifications and Scope

It will be appreciated from the foregoing description that the present invention represents a significant advance in the detection and removal of interrupted fuses. In particular it provides for a quick and simple means to check fuse conditions in multiple fuse locations without individual fuse inspection, in physically difficult areas, and in situations with insufficient light, where markings and subsurface indications may not be ascertainable. This is accomplished by providing physical attributes which allow convenient observation of the interrupted fuse either through visual or tactile inspection.

In addition, the present invention provides an easy self contained method of interrupted fuse extraction, requiring no additional tools.

Further, the present invention allows the use of less expensive materials.

Still further, the present invention allows usage with existing technologies and practices.

It will also be appreciated that, although specific embodiments of the present invention have been described here for purposes of illustration, various modifications may be made, such as a cylinder type fuse where a portion of the housing pivots when the meltable link melts. In addition many other alternatives are available, such as an indicator where the flange is a shaft or, is round or spherical, or pivots on an alternate axis, or is of a flexible material such as a strap or cord which can be pulled out of the housing.

It will be further appreciated that the embodiments of the present invention described here for purposes of illustration are descriptions of fuses in current production and that future fuse designs will call for further embodiments.

These and other embodiments are possible without departing from the spirit and scope of novel concepts of the present invention so that the scope of the present invention should be determined by the appended claims only.

I claim:

1. A fuse interruption indicator comprising:

a fuse constructed with: a housing, conductive terminals, and a meltable link joining said terminals;

an opening in at least one side of said housing;

a flange positioned to be extendible through said opening, said flange having an extension;

said extension having engagement means with said meltable link;

spring means biasing said flange through said opening;

said extension having positive stop means to prevent removal through said opening; and said flange forms a gripping area and interruption indicator.

2. The fuse interruption indicator of claim 1, wherein said extension is manually extendible through said opening.

3. The fuse interruption indicator of claim 1, wherein said flange has pivot means.

4. The fuse interruption indicator of claim 1, wherein said extension has pivot means.

5. The fuse interruption indicator of claim 1, wherein said flange encompasses a substantial portion of top surface of said housing.

6. The fuse interruption indicator of claim 1, wherein said flange encompasses a substantial portion of outer surface of said housing.

7. The fuse interruption indicator of claim 1, wherein said spring means prevents removal of said extension through said opening.

8. The fuse interruption indicator of claim 1, wherein said spring means is formed integral with said extension.

9. The fuse interruption indicator of claim 1, wherein said spring means is formed integral with said housing.

10. The fuse interruption indicator of claim 1, wherein a flexible material is joined at one end to said flange;

said flexible material being joined at the opposite end to a section of said housing; and said flexible material being stored within said housing, and extensible through said opening.

11. The fuse interruption indicator of claim 1, wherein said flange is depressable.

12. A fuse interruption indicator comprising:

a fuse constructed with: a housing, conductive terminals, and a meltable link joining said terminals;

said conductive terminals and said housing joined by slideable attachment means with limited travel;

said housing having engagement means with said meltable link; spring means biasing said housing away from said meltable link; and said housing forms a gripping area and interruption indicator.

13. The fuse interruption indicator of claim 12, wherein said housing is manually extendible relative to said terminals.

14. The fuse interruption indicator of claim 12, wherein said spring means is formed integral with said housing.

15. The fuse interruption indicator of claim 12, wherein said spring means limits motion of housing relative to said terminals.

16. The fuse interruption indicator of claim 12, wherein said housing is depressable.

17. A fuse interruption indicator comprising:

a fuse constructed with: a housing, conductive terminals, and a meltable link joining said terminals;

said housing formed of at least two parts;

a first housing part joined to a second housing part by slideable attachment means with limited travel;

said conductive terminals being attached to said second housing part;

first housing part having engagement means with said meltable link;

spring means biasing said first housing part away from said meltable link; and said first housing part forms a gripping surface and interruption indicator.

18. The fuse interruption indicator of claim 17, wherein said first housing part is manually extendible relative to said second housing part.

19. The fuse interruption indicator of claim 17, wherein said first housing part is pivotably attached to said second segment.

20. The fuse interruption indicator of claim 17, wherein said first housing part encompasses a substantial portion of top surface of said fuse.

21. The fuse interruption indicator of claim 17, wherein said first housing part encompasses a substantial portion of outer surface of said fuse.

22. The fuse interruption indicator of claim 17, wherein said spring means is formed integral with said first housing part.

23. The fuse interruption indicator of claim 17, wherein said spring means is formed integral with said second housing part.

24. The fuse interruption indicator of claim 17, wherein said spring means limits motion of first housing part relative to second housing part.

25. The fuse interruption indicator of claim 17, wherein said first housing part is depressable.

* * * * *